United States Patent [19]

Blatt

[11] Patent Number: 4,988,261

[45] Date of Patent: Jan. 29, 1991

[54] MULTIPLE MOTION TRANSFER APPARATUS

[76] Inventor: John A. Blatt, 22 Stratton Pl., Grosse Pointe Shores, Mich. 48236

[21] Appl. No.: 418,257

[22] Filed: Oct. 6, 1989

[51] Int. Cl.[5] ..... B65G 35/00

[52] U.S. Cl. ..... 414/749; 74/479; 108/143; 248/669; 269/60; 269/71

[58] Field of Search ..... 414/749, 750, 751, 222, 414/225; 74/479; 108/143, 137, 20, 21, 22; 248/656, 657, 669; 269/60, 71

[56] References Cited

U.S. PATENT DOCUMENTS

| | | | |
|---|---|---|---|
| 2,813,380 | 11/1959 | Narel et al. | 51/105 |
| 3,199,443 | 8/1965 | Danly | 100/207 |
| 3,881,362 | 5/1975 | Beezer | 414/749 X |
| 3,945,504 | 3/1976 | Wright | 212/220 X |
| 4,364,706 | 12/1982 | Kranzlmüller | 414/733 |
| 4,553,444 | 11/1985 | Blatt | 74/110 |
| 4,575,299 | 3/1986 | Layton et al. | 414/222 |
| 4,896,869 | 1/1990 | Takekoshi | 269/60 |

*Primary Examiner*—Robert J. Spar

*Assistant Examiner*—Donald W. Underwood

*Attorney, Agent, or Firm*—Basile and Hanlon

[57] ABSTRACT

An article transfer apparatus includes a power driven shuttle carriage mounted for movement along a first linear path between opposite end limits. An article holder assembly includes a base mounted on the carriage for movement relative to the carriage along a second linear path normal to the first linear path between opposite end limits. The holder base mounts a sleeve slidable along an elongate guide rod whose opposite ends may be independently positioned transversely of the first linear path. The guide rod may thus be located to extend parallel to or to be inclined relative to the first path to accordingly enable the sleeve position the holder on this second linear path or to move the holder base transversely of the carriage driving movement of the carriage along the the first path. An article holder unit mounted on the base may be manually adjusted about one axis relative to the base and driven in rotative adjustment relative to the base about a second axis by a reversible power drive mounted upon the base.

13 Claims, 6 Drawing Sheets

MULTIPLE MOTION TRANSFER APPARATUS

FIELD OF THE INVENTION

The present invention is directed to article transfer apparatus which receives an article or work piece from a loading device at a first work station and transfers the work piece to a second work station at which an unloading device removes the work piece from the transfer apparatus and loads it into the second work station.

BACKGROUND OF THE INVENTION

A transfer apparatus of the general type with which the present invention is concerned is disclosed in the U.S. Pat. No. 4,553,444. The apparatus disclosed in that patent includes a pair of fixed parallel tracks upon which a shuttle carriage is mounted for power driven movement longitudinally of the tracks from one end of the tracks to the other. Although not disclosed in detail in that patent, which is primarily directed to the mechanism employed to drive the shuttle carriage, a work piece holder is mounted upon the shuttle carriage. In a typical application, the transfer apparatus is positioned to extend between two machines which perform successive operations upon a work piece. The shuttle carriage is positioned at the end of its track adjacent the first machine and an automatic or robotic device is employed to extract a work piece from the first machine and load the work piece onto the work holder of the transfer apparatus, which then drives the shuttle carriage with the work piece to the opposite end of the transfer unit. A second automatic device then removes the work piece from the shuttle carriage and loads it into the second machine.

Because the loading and unloading of the transfer apparatus is performed by automatic devices, it is essential that the work holder of the transfer unit be precisely positioned at each end of its stroke to be in a proper orientation and alignment with the loading or unloading device. Where the production line in which the transfer apparatus is employed handles only work pieces of single configuration, problems of establishing the desired alignment between the transfer unit and the loading and unloading devices are simply solved by the initial set up of the unit. However, particularly in automotive related industries, present day practice requires that many production lines, particularly those employ machines involving a large capital investment, be capable of rapid conversion from production of one part to the production of a different part. Such a change over, in addition to the required modification of the tooling, can, and usually does, require modifications to the loading and unloading apparatus and changes to the work holder structure and its orientation upon the transfer unit, and possible a relocation of the end positions of the shuttle carriage.

One example of such a production line is one which is employed to stamp inner door panels for automotive vehicle doors. These inner door panels are employed to mount the door latching and window operating mechanisms and are of a complex shape such that the work piece blank passes through several successive stamping operations before it is finished. Transfer units of the general type referred to above are employed to transfer the work piece blank from one press to the next. Typically, two or more different inner door panel configurations are required for each different model of automobile- right and left handed configurations for two door automobiles, and right and left front and rear door configurations for four door automobiles.

Press lines for stamping parts of such complex shape include a series of relatively large presses fixedly mounted on the shop floor in spaced relationship to each other along a straight line. The transfer units extending between adjacent presses will have their longitudinal centerlines aligned with the straight line path through the presses. Where it is intended that the line will be shifted at fairly frequent intervals from production of one part to production of a different part, to accomplish a quick change is set up, the loading and unloading devices are provided with quick change modular work piece gripping heads, and a matched set of work piece holders are provided for the transfer unit, again with quick change couplings accommodating rapid removal and replacement upon the shuttle carriage of the transfer unit. By appropriate design, these matched pairs of work piece grippers and work piece holders will minimize or eliminate the necessity of reorientation or realignment of the transfer unit with its associated loading and unloading devices upon conversion from the handling of one part to the handling of another.

However, where the line must be capable of handling several different parts of differing sizes, shapes and configurations, it is frequently necessary to shift the orientation of the part between successive presses. Loading of the part upon the work holder on the shuttle carriage may, for example, be most conveniently accomplished if the work holder is inclined toward the adjacent side of the press from which it receives the part and is reversely inclined for the unloading operation at the opposite end of its stroke. Also, the geometry of the part may be such that shifting the part transversely of its path of travel between the two presses may be desirable.

Shifting of the position of the part relative to the fixed frame of the transfer apparatus during transit from one end of the apparatus to the other will normally require some powered device mounted upon the shuttle carriage, and the supply of power to these actuating devices will require the coupling of an electrical cable or pneumatic hose to some point on the carriage. In that the path of travel of a typical shuttle carriage may be ten feet or more, the handling of these power cables or supply lines, which must be connected at one end to a stationary power outlet presents a problems. Guidance and handling of a single line extending from a fixed supply location to the moving carriage can easily be handled with an articulated cable guide of well known construction. However, when two or more power supply lines or cables must be attached at one end to a movable shuttle carriage at locations on the carriage which are in turn moveable relative to one another, a single cable guide is not sufficient and two or more cable guides leading to relatively moveable points on the shuttle present an exceedingly complex design problem.

The present invention is directed to a transfer unit which includes a work holder mounted upon a shuttle carriage for independent adjustable movement in two types of movement relative to the shuttle carriage while requiring but a single supply cable connection to the carriage.

SUMMARY OF THE INVENTION

A transfer unit embodying the present invention includes an elongate frame having a pair of elongate fixed guide rails extending longitudinally of the frame substantially from one end of the frame to the other. A shuttle carriage is mounted upon these guide rails by suitable roller assemblies for straight line movement longitudinally of the frame from one end to the other and may be driven in such movement by a suitable power drive means, such as that disclosed in Pat. No. 4,553,444 or by a power driven ball screw arrangement.

Mounted at each end of the frame are second fixed track assemblies which extend horizontally transversely of the frame perpendicular to the path of travel of the carriage. Each of these transversely extending second tracks slidably carries a coupler assembly which may be positioned along the second tracks by a power drive screw threadably received in a nut fixedly mounted in the coupler. The coupler includes a block like member fixedly mounting the nut and slidably guided in the secondary tracks, and within the block, a support member is mounted for pivotal movement relative to the block about a vertical axis. An elongate guide rod is fixedly coupled at one end to the support member at one end of the frame and is coupled at its other end to the support member at the opposite end of the frame by a pin projecting from this last support member longitudinally into a recess at the end of the guide rod extending along the guide rod axis to accommodate sliding movement of the guide rod longitudinally of its axis relative to this last support member. The two coupling members may be independently positioned at any location transversely of the fixed frame by actuation of individual motors coupled to the respective screws threaded into the nuts on the coupling members. The guide rod ends are thus correspondingly located relative to the fixed frame and guide rod may be thus selectively positioned to extend in parallel relationship to the path of travel of the shuttle carriage or in an inclined relationship to the path of travel.

The shuttle carriage mounts a pair of support rods which extend horizontally of the shuttle carriage in a direction normal to the path of travel of the carriage. A work holder carrier is slidably mounted upon the support rods for movement relative to the shuttle carriage along a path extending normal to the path of travel of the carriage.

A guide sleeve slidably received upon the guide rod is coupled to the work holder carrier for pivotal movement about a vertical axis. Thus, during travel of the shuttle carriage longitudinally of the frame from one end to the other, the work holder carrier will be shifted transversely of the shuttle in accordance with the amount by which the opposite ends of the guide rod are transversely offset from the longitudinal centerline of the frame. Thus, transverse shifting movement of the work holder carrier is achieved without requiring the connection of a power cable to the shuttle carriage.

A work holder base is mounted upon the work holder carrier for pivotal movement relative to the carrier about an axis which, in the embodiment disclosed, is a horizontal axis normal to the path of movement of the shuttle carriage. The work holder base may be driven in pivotal movement relative to the work holder carrier by a motor driven screw mounted on the carrier and threadably received in a nut carried by the work holder base.

The work holder base is provided with a quick change coupling by means for which work holders of different configurations may be mounted upon the base.

Other objects and features of the invention will become apparent by reference to the following specification and to the drawings.

IN THE DRAWINGS

Figure 1:
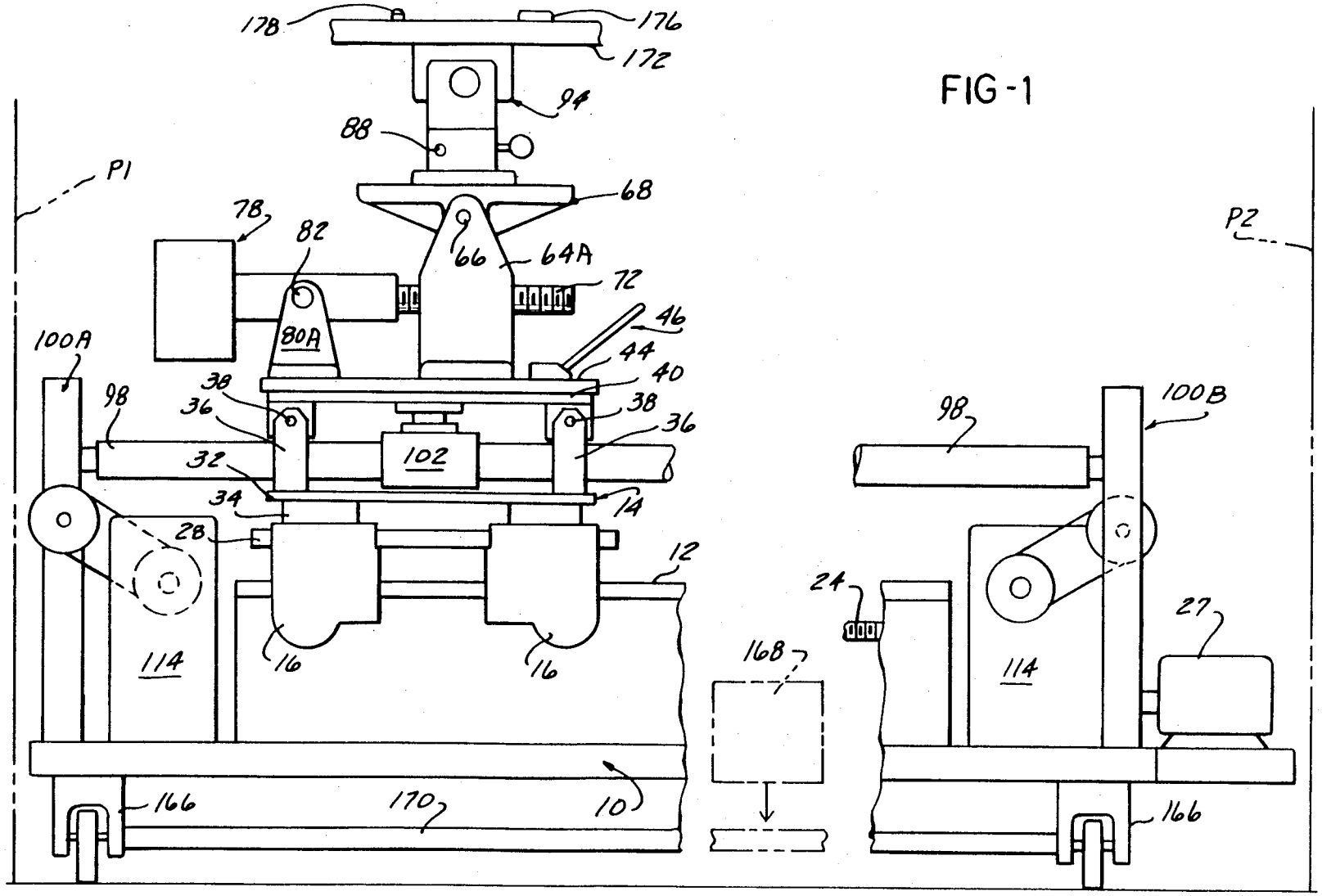
FIG. 1 is a simplified side elevational view, partially broken away, of a transfer unit embodying the present invention.
Figure 2:
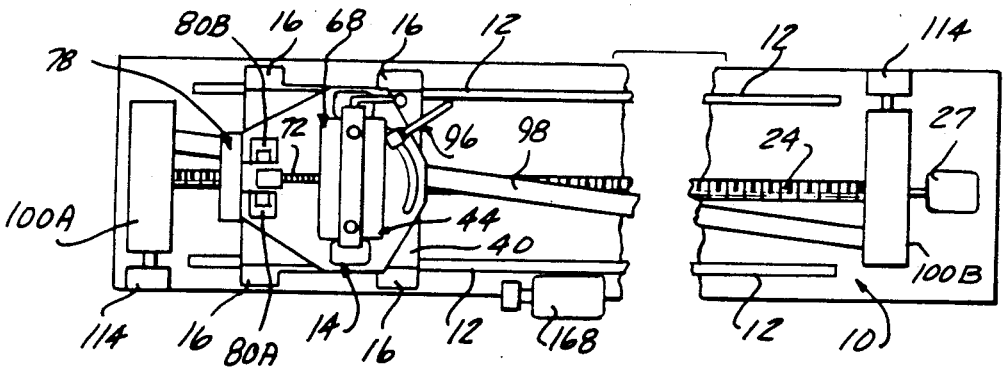
FIG. 2 is a simplified side view of the transfer unit of FIG. 1.
Figure 4:
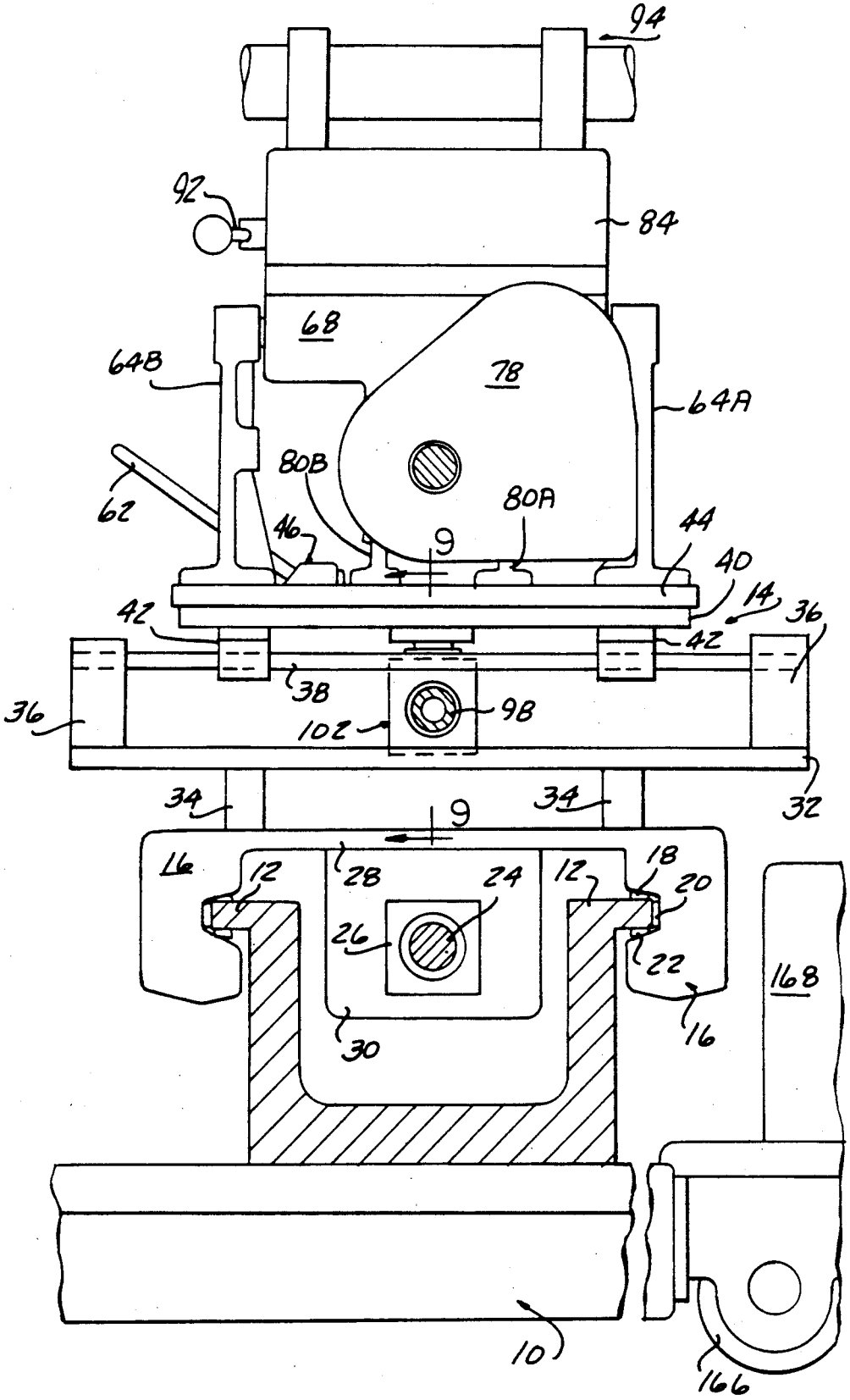
FIG. 4 is a simplified end view, with certain parts broken away or shown in section, of the shuttle carriage of FIG. 3.

A transfer apparatus embodying the present invention includes, as best seen in FIGS. 1 and 2, an elongate rigid frame designated generally 10 upon which are fixedly mounted a pair of elongate guide rails 12 which extend substantially the entire length of the frame 10. A shuttle carriage assembly designated generally 14 is mounted upon guide rails 12 by roller assemblies 16 each of which, as best seen in FIG. 4 includes three freely rotatable rollers 18, 20 and 22 respectively engaged with the upper, outer nd lower surfaces of a guide rail 12.

Shuttle carriage assembly 14 is driven in movement along guide rails 12 by a suitable power drive assembly which, in the form shown in the drawings, takes the form of an elongate power driven screw 24 operatively received within a ball nut 26 (FIG. 4) fixedly mounted on the bottom of carriage 14. Screw 24 is driven in rotation by a reversible drive motor 27 mounted upon frame 10. The ball screw drive shown in the drawings is but one of several forms of conventional shuttle carriage drives employed in transfer units of this general type, the rack and pinion drive disclosed in U.S. Pat. No. 4,553,444 is but one other example of a drive widely used in applications of this type. The particular type of drive which is used will depend upon the application of the transfer apparatus, and is usually selected with consideration of the weight of the articles to be handled, the speed at which the article is to be transferred, and the degree of precision required of the drive in locating the carriage at each end of its path of travel on the guide rails.

The shuttle carriage assembly 14 of the transfer unit of the present invention includes as the basic shuttle carriage a rigid lower carriage plate 28 upon which the roller housings 16 and a block 30 (FIG. 3) for coupling the carriage to the carriage drive are fixedly mounted. In the assembly shown in the drawings, a rigid upper carriage plate 32 is fixedly mounted upon the top of lower carriage plate 28 as by spacer blocks 34. At each of the opposite sides of upper carriage plate 32, a pair of upwardly projecting support blocks 36 are fixedly mounted to support above upper plate 32 a pair of parallel support rods 38 which extend in horizontal parallel relationship to each other transversely across the support plate.

A work holder platform base plate 40 is supported upon support rods 38 by pairs of sleeves 42 (FIG. 4) fixedly mounted on the under side of plate 40 and slidably received on the support rods 38. A second plate 44 may be mounted upon base plate 40 for rotative adjustment upon plate 40 about a vertical axis and clamped in position by a clamp 46.

Figure 5:
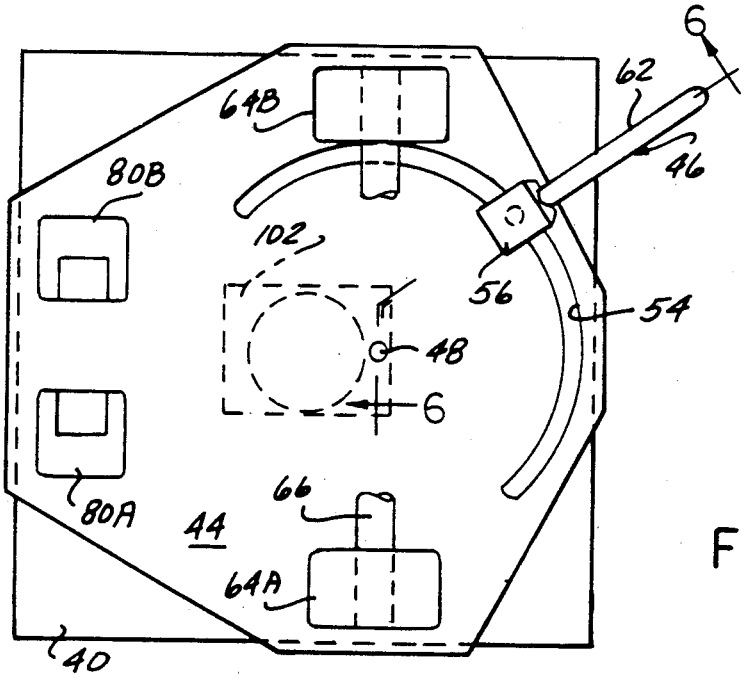
FIG. 5 is a top plan view of the workholder support assembly with certain parts broken away or omitted.
Figure 6:
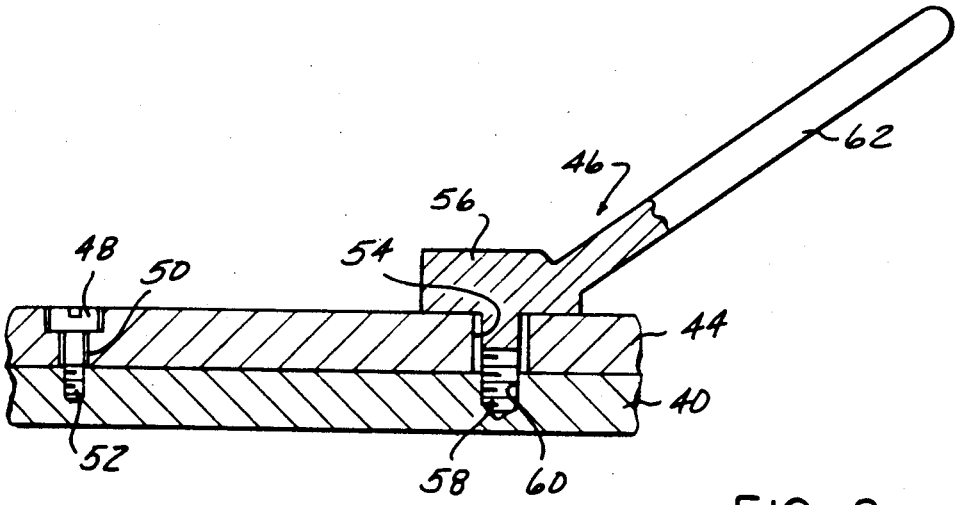
FIG. 6 is a cross sectional view taken on the line 6—6 of FIG. 5.

As best seen in FIGS. 5 and 6, plate 44 rests upon the top of base plate 40 and is located upon plate 40 by a pivot pin 48 which passes through a bore 50 in plate 44 and is threadably received within a tapped bore 52 in base plate 40. As best seen in FIG. 5, pivot pin 48 is offset somewhat from the true center of base plate 40. An arcuate slot 54 is cut through plate 44 along a fixed radius from the axis of pivot 48 and extends substantially 180° about the pivot pin axis. Clamp 46 includes a clamping dog 56 threadably received on a threaded stud 58 which extends freely through slot 54 and is fixedly secured at its lower end to base plate 40. A manual actuating lever 62 is fixedly mounted upon dog 56. From FIG. 6, as believed apparent that by rotating dog 56 slightly in an unthreading direction, the dog will be loosened to a point where the plate 44 may be pivoted about pivot pin 48 within the limits imposed by the opposite ends of slot 54, and then clamped in position by tightening dog 56 to firmly clamp plate 44 against base plate 40.

Figure 3:
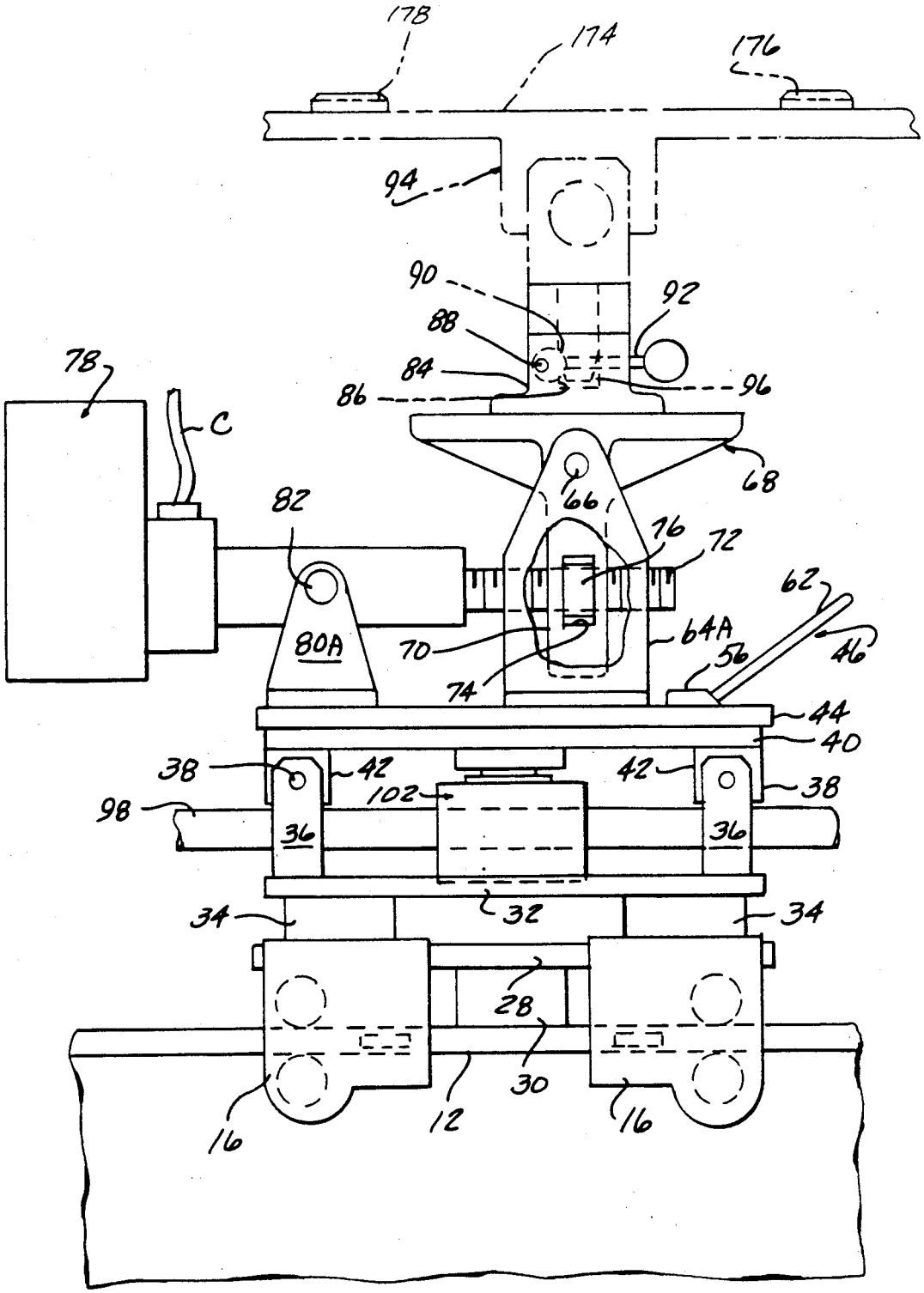
FIG. 3 is a detail side elevational view of a shuttle carriage assembly employed in the transfer apparatus of FIG. 1 with certain parts broken away.

A pair of pedestals 64A, 64B are fixedly mounted upon and project upwardly from plate 44 to fixedly support a pivot shaft 66 mounted in and extending between the upper ends of pedestals 64A, 64B. A work holder bracket assembly designated generally 68, see particularly FIGS. 3 and 4, is supported upon pivot shaft 66 for free rotation about the axis of shaft 66. Bracket 68 includes a pair of legs 70 which project downwardly from the bracket in spaced parallel relationship to each other to straddle a drive screw 72 which passes freely between the two legs 70. Each leg 70 is formed with a slot 74 extending radially of the axis of pivot rod 66 and a nut 76 has opposite side ends slidably received in the slots 74. Screw 72 is threadably received in nut 72 and is driven by an electric drive motor- speed reducer designated generally 78 mounted upon plate 44 by a second pair of pedestals 80A, 80B for pivotal movement about an axis established by pins 82. Actuation of motor assembly 78 drives screw 72 in rotation to pivot work holder bracket 68 upon pivot rod 66.

A quick change coupling device is fixedly mounted at the top of work holder bracket 68 and includes a housing 84 having two or more bores 86 extending downwardly into the housing. A shaft 88 is rotatably mounted within the housing to extend substantially the entire length of the housing and carries two or more eccentric locking cams 90 fixed to and rotatable with shaft 88 into and out of bores 86. Rotation of the shaft by manual manipulation of an arm 92 will drive the large diameter portion of each cam 90 into and out of a bore 86. A work holder platform assembly designated generally 94 carries two or more downwardly projecting pins 96 located to be received in the bores 86 and housing 84. The pins 96 are formed with arcuate recesses conformed to receive cams 90 as indicated in FIG. 3 to lock work holder 94 in position upon bracket 68. To release work holder 94, crank 92 is manually rotated to a position in which the eccentric cams 90 are withdrawn from the recesses in pins 96, and the work holder 94 is then lifted clear of the work holder bracket.

Base plate 40 of the work holder support structure is supported by support sleeves 42 upon support rods 38 for sliding movement upon shuttle carriage 14 transversely of the longitudinal path of movement of the shuttle carriage along tracks 12. The work holder supporting carrier which includes base plate 40 is positioned transversely of rails 12 by structure which includes an elongate guide rod 98 having its opposite ends mounted in guide rod support assemblies 100A, 100B located adjacent opposite ends of frame 10. A sleeve assembly 102 is received upon guide rod 98 for free sliding movement longitudinally along rod 98 and is mounted upon the underside of plate 40 for pivotal movement relative to the plate about a vertical axis.

Figure 7:
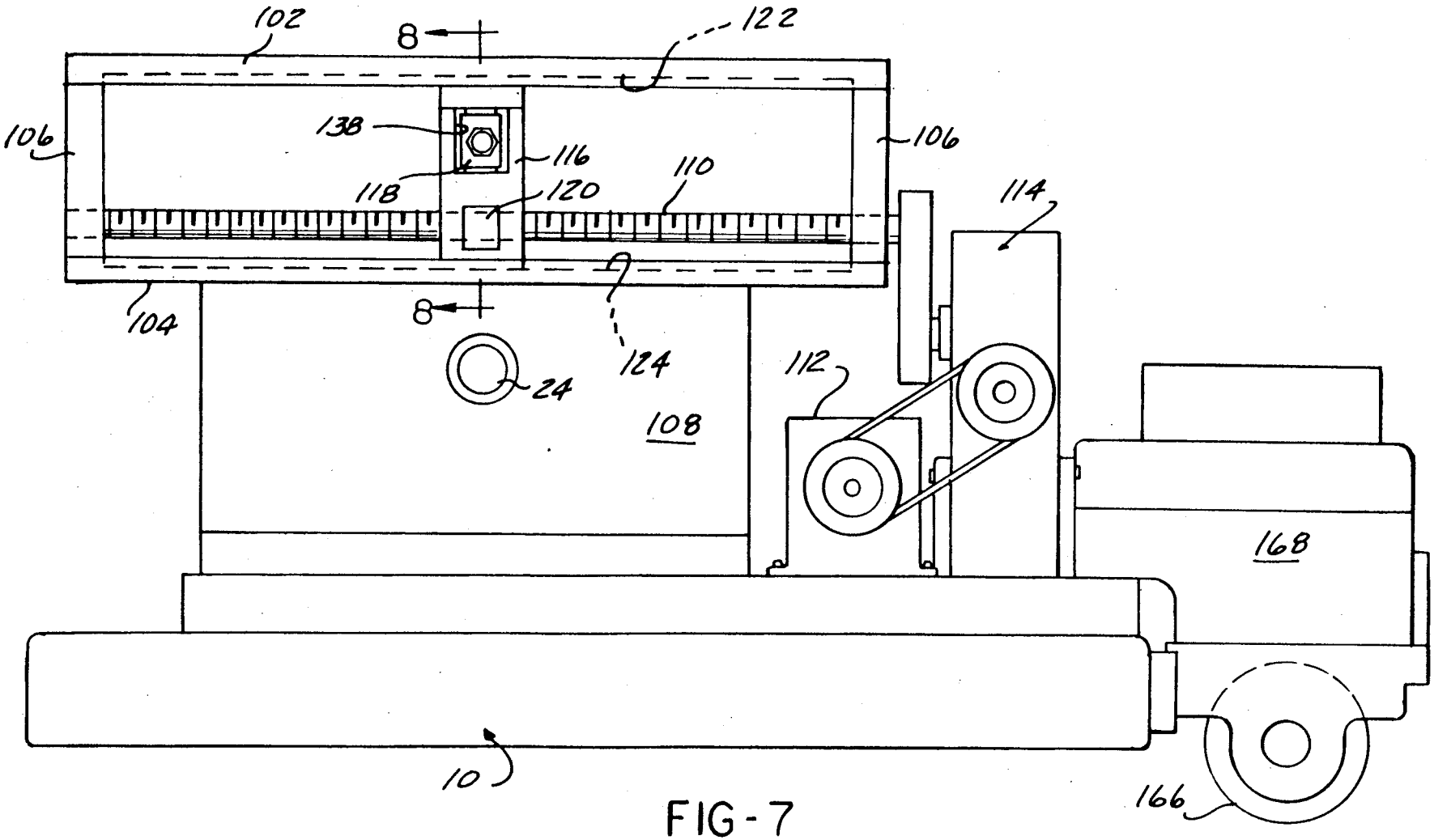
FIG. 7 is a simplified end view of the guide rod support assembly located at one end of the transfer apparatus of FIG. 1.
Figure 9:
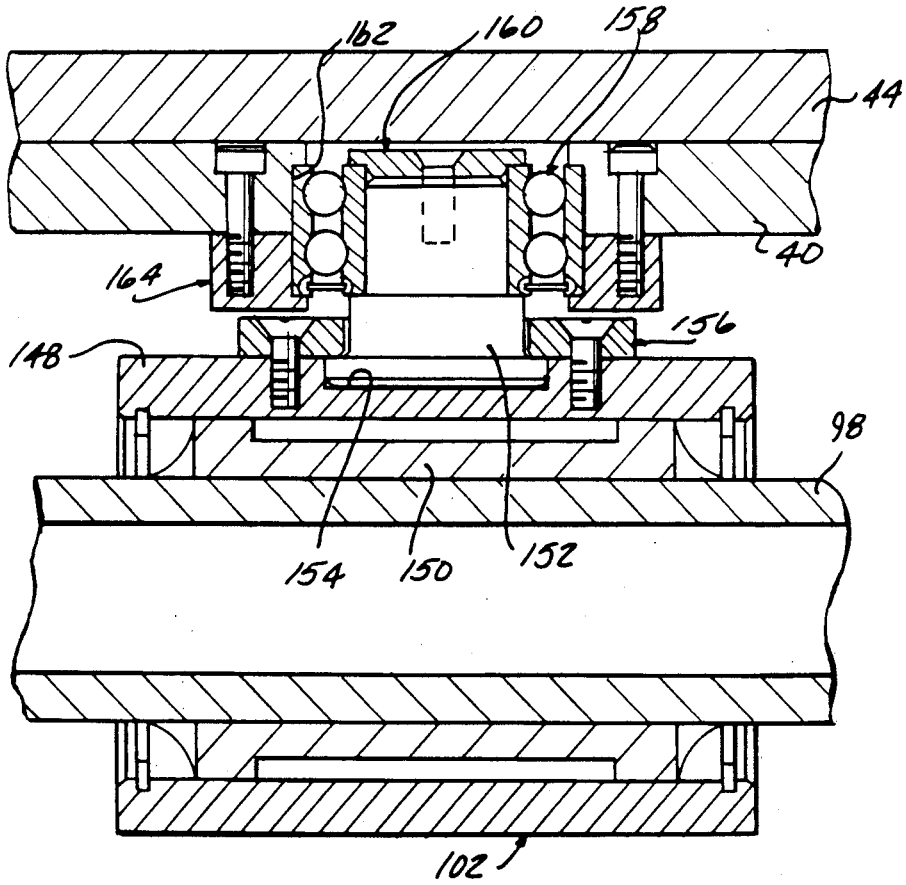
FIG. 9 is a detail cross sectional view taken on the line 9—9 of FIG. 4.
Figure 8:
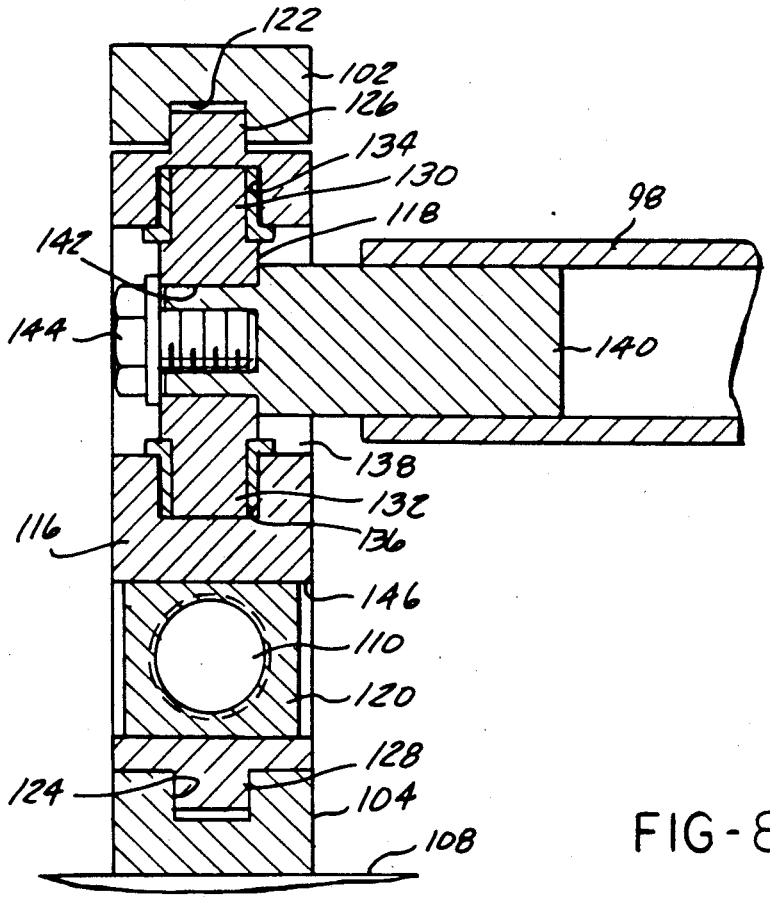
FIG. 8 is a detail cross sectional view taken on the line 8—8 of FIG. 7.

Details of rod support assemblies 100A, 100B and sleeve assembly 102 are best seen in FIGS. 7–9.

Guide rod support assemblies 100A and 100B are of similar construction, and the following description of guide rod support assembly is equally applicable to assembly 100B. As best seen in FIG. 7, guide rod assembly 100A includes a generally rectangular open frame including elongate upper and lower track members 102, 104 and end frame members 106 fixedly supported upon frame 10 as by a support element 108. An elongate screw 110 is supported by end frame members 106 for free rotation relative to the frame members and is driven in rotation by a reversible drive motor 112 mounted on frame 10 and coupled to screw 110 by a suitable speed reducer arrangement designated generally 114. A sliding support block 116 is supported between the upper and lower tracks 102, 104 and carries a pivotal coupling member 118 which is mounted within block 116 for pivotal movement relative to block 116 about a vertical axis. Block 116 also carries a nut 120 which is threadably received upon screw 110.

Referring now particularly to FIG. 8, it is seen that tracks 102 and 104 are each formed on their facing sides with a slot 122, 124 which receive projecting tongues 126, 128 mounted at the upper and lower ends of support block 116 to guide block 116 in sliding movement longitudinally of tracks 102, 104. Coupling member 118 is supported for pivotal movement within block 116 by pin portions 130, 132 at its upper and lower ends which are received within bores 134, 136 in block 116. The central portion of coupling member 118 extends vertically across an opening 138 through block 116, and within this opening, a coupling rod 140 is formed within a reduced diameter end snugly received within a bore 142 extending horizontally through coupling member 118. A bolt 144 is threadably received within the reduced diameter end of coupling rod 140 to fixedly mount the rod 140 on coupling member 118. Coupling rod 140 is slidably received within the end of guide rod 98. Nut 120 is slidably received within a second opening 146 in block 116.

Referring now to FIG. 7, it is believed apparent that actuation of drive motor 112 to rotate screw 110 will drive support block 116 longitudinally of tracks 102, 104 and that block 116 may be located at any selected position along these tracks by appropriate actuation of the motor. The guide rod assemblies 100A, 100B which support the opposite ends of guide rod 98 are operable independently of one another, hence guide rod 98 may be positioned at any selected inclination or offset relative to the longitudinal center line of the frame, as indicated in FIG. 2.

Details of sleeve assembly 102 are best seen in FIG. 9. Assembly 102 includes a hollow cylindrical sleeve 148 which carries within its interior a bushing 150 of a suitable low friction material which is slidably received upon guide rod 98. A stud like coupling member 152 is fixedly seated within a recess 154 in sleeve 148 and retained within the recess by a first retainer assembly designated generally 156. At the upper end of coupling member 152, the inner race of a ball bearing designated generally 158 is seated upon coupling member 152 and retained on member 152 as by a second retainer assembly designated 160. The outer race of bearing 158 is seated within a counter bore 162 in plate 40 and retained in this seated engagement with plate 40 as be a third retainer assembly designated generally 164. Sleeve 148 is thus supported from plate 40 for pivotal movement relative to the plate about the axis of bearing 158.

Referring now to FIG. 1, in a typical application, the transfer unit will be positioned between two machines, such as a press P1 and a second press P2 to transfer a part from press P1 to press P2. When the line is shifted from production of one part to production of a second part, it is necessary to change the dies in the two presses, and the transfer unit may be located in position such that it interferes with the die changing operation. Where this situation exists, the transfer unit may be provided with casters 166, at least one pair of which are driven by a reversible drive motor 168 mounted on frame 10 and drivingly coupled to the casters as by a drive shaft 170 driven by motor 168 as by a chain and sprocket drive (not shown).

The configuration of work holder 94 is matched to the part or work piece to be transferred by the transfer unit. The unit is widely employed to transfer sheet metal parts from one press to another, and a typical part of this type is an inner door panel for a vehicle door which is especially formed and configured to mount and support the door latch and window operating mechanisms of the completed door. This particular panel is formed with a number of openings of various sizes and shapes and with several indentations or projection portions which are offset to one side or another of the general plane of the panel. For handling parts of this type, referring now to FIG. 1, the work holder 94 will take the form of a platform 172 whose upper surface is conformed to one side surface of the part to be handled, this upper surface being conveniently produced by forming a mold of a suitable plastic material directly from the surface of the part itself. Although not absolutely essential, preferably the upper surface 174 of the platform 172 may include one or more projections such as 176, 178 shaped to pass through openings in the part. A part holder of the type just described is sometimes referred to as a nest for the part in which the part is gravitationally seated during the transfer operation. Such a nest provides a fairly precise location and orientation of the part relative to the work holder and does not require that the holder be equipped with a pneumatic supply line to actuate and release part holding clamps.

OPERATION

For purposes of explaining the operation of the transfer unit described above, it will be assumed that the unit is set up, as indicated generally in FIG. 1 between two presses for the purpose of transferring a sheet metal part, such as an automotive inner door panel from press P1 to press P2. Automatic loading and unloading units (not shown) of well known construction will be employed adjacent press P1 to extract a part from the press and load it unto the work holder platform of the transfer unit when shuttle carriage 14 is at that end of its path of movement adjacent press P1. When the carriage is at its opposite end limit of movement, an unloading unit (not shown) will lift the part from the work holder and load it into press P2. Loading and unloading units suitable for this purpose are well known and basically consist of a power driven articulated arm detachably coupled at its outer end to a rigid frame which carries a group of vacuum cups arranged in a pattern matched to the part to be handled to stably support the part from the frame when vacuum is applied to the cups. The frame typically is coupled to the articulated arm by a quick disconnect pneumatic coupling for inducing vacuum in the cups when the frame is attached to the arm. Conversion of the system from handling one part to the handling of a different part will require a corresponding change of the vacuum cup holding frames of the loading and unloading devices.

To transfer a part from press P1 to press P2, the transfer unit is first located in the correct position between the two presses. The guide rod support assemblies 100A and 100B are then independently positioned by the operation of their screw drive motors to locate the respective opposite ends of the guide rode 98 transversely of frame 10 (see FIG. 2) as may be required by the part configuration, orientation of the dies and presses P1 and P2 relative to one another and the operating paths of the respective loading units which transfer the part on the press to the transfer unit and vice versa. Shuttle carriage 14 is then positioned at its left hand end limit of travel as viewed in FIG. 1 by actuation of its drive motor 27. If necessary, upper plate 44 of the work holder assembly is rotatably adjusted relative to its base plate 40 as described above, and motor 78 is actuated to pivot work holder bracket 68 about the axis of pivot rod 66 as may be required to locate work holder platform 172 in the desired location and orientation relative to the path of movement of the part loading device. Usually, it is most convenient to have platform 172 when in its part receiving position, tilted downwardly toward the left as viewed in FIG. 1 because this will in most cases provide additional clearance and simplification of the path of movement of the loading device in transferring a part from press P1 to the platform.

After the part has been loaded on work holder platform 172, the shuttle drive motor is actuated to drive the shuttle carriage to the opposite end of its path of movement along rails 12. Referring now to FIG. 2, if guide rod 98 has been positioned in an inclined relationship to the longitudinal centerline of frame 10, as shuttle carriage 14 moves to the right as viewed in FIG. 2, the sleeve 102 which is mounted upon the bottom of plate 40 will, as its slides to the right along the guide rod 98 force plate 40 to move transversely of shuttle carriage 14 by virtue of the inclination of guide rod 98 with respect to the path of movement of the shuttle carriage.

Thus, the part supporting platform 172 and the part carried by the platform may be shifted a predetermined distance transversely of the path of travel of the shuttle carriage during its movement between the two presses.

If, as described above, the part supporting platform as been tilted to facilitate loading of the part on to the platform, it will normally be desirable to tilt the platform in the opposite direction to similarly facilitate the unloading. This may be accomplished during transit of the part on the transfer unit by actuation of motor 78 to drive screw 72 to so tilt the work holder bracket 68 and platform 172. In that motor 78 is mounted upon base plate 40 which must move both transversely and longitudinally relative to frame 10, it is necessary to connect one end of a flexible power cable C (FIG. 3) to the motor and to connect the opposite ends of the power cable C to a stationary source of power, not shown. This is the only movable power connection required to the transfer unit, and this cable may be controlled by a suitable articulated cable guide of a type well known in the art. All of the remaining drive motors of the transfer unit are mounted at fixed locations on the fixed frame 10 of the transfer unit.

While the work holder bracket 68 is shown as being mounted for pivotal movement about a horizontal axis, it is believed apparent that if desired, the same type of screw drive arrangement could be employed to drive a work holder bracket in pivotal movement about a vertical axis through an angle of 180° to reverse the front to rear orientation of the part during transfer.

Thus, while one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. Article transfer apparatus comprising an elongate frame including longitudinally extending main guide rail means and first and second transversely extending secondary guide rail means located respectively at the opposite ends of said main guide rail means, first and second support block means slidably mounted on the respective first and second secondary guide rail means for sliding along respective first and second paths extending movement transversely of said frame, first and second independently operable power drive means on said frame coupled respectively to said first and second support block means for locating said first and second support block means at independently selected positions on their respective first and second paths, an elongate rigid guide member, coupling means at each end of said guide member mounting the respective ends of said guide member upon said first and said second support block means for movement therewith transversely of said frame, shuttle means mounted on said frame for movement along said main guide rail means between the opposite ends thereof, article carrier means mounted on said shuttle means for movement relative to said shuttle means transversely of said frame, and sleeve means on said carrier means received on said guide member for sliding movement longitudinally along said guide member and operable to position said carrier means transversely of said frame in accordance with the position of said guide member relative to said main guide rail means established by said first and second support block means.

2. The invention defined in claim 1 further comprising article holder means mounted on said carrier means for pivotal movement relative to said carrier means about a pivot axis and third power drive means for driving said article holder means in pivotal movement about said pivot axis.

3. The invention defined in claim 1 wherein said coupling means includes pivot means mounting said guide member for pivotal movement relative to the associated support block means about a block axis normal to the longitudinal extent of said guide member and to the transverse path of movement of said support block means, and means accommodating longitudinal movement of said guide member relative to said support block means.

4. The invention defined in claim 3 wherein said sleeve means comprises a hollow tubular sleeve slidably received upon said guide member, and means mounting said carrier means upon said sleeve for pivotal movement about an axis parallel to said block axis.

5. The invention defined in claim 1 wherein said shuttle means comprises a pair of side frame members at transversely opposite sides of said shuttle means, a plurality of guide rods fixedly mounted on said extending transversely between said side frame members in spaced parallel relationship to each other, and said carrier means comprises a carrier body slidably supported upon said guide rods.

6. The invention defined in claim 5 wherein said carrier means further comprises article holder means mounted on said carrier body for pivotal movement relative to said carrier body about a pivot axis, and positioning means mounted on said carrier body operable to shift said holder means about said pivot axis between a first and a second end limit of pivotal movement.

7. The invention defined in claim 6 wherein said pivot axis extends parallel to said guide rods.

8. In an article handling apparatus including a shuttle carriage mounted upon an elongate frame for movement along a first linear path extending longitudinally of said frame substantially from one end of said frame to the other end, first reversible drive means for driving said carriage along a said first linear path, and article holding means mounted upon said carriage for releasably supporting an article upon said carriage;

the improvement wherein said article holding means comprises base means mounted upon said carriage for movement relative to said carriage along a second linear path normal to said first linear path, first and second guide rod support means mounted on said frame respectively adjacent said one and said other ends of said frame for movement along respective third and fourth fixed linear paths parallel to said second linear path, an elongate guide rod having its opposite ends respectively supported on said first and second support means for movement therewith, independently operable first and second positioning means mounted on said frame for respectively independently positioning said first and second support means on said third and fourth paths to thereby locate and orient said rod at a selected position relative to said first path, slide means mounted on said base means and received upon said rod for sliding movement along said rod for locating said base means on said second linear path in accordance with the position of that portion of said rod engaged by said slide means, and article engaging means mounted on said base means for supporting an article thereon.

9. The invention defined in claim 8 wherein said article engaging means comprises bracket means mounted on said base means for controlled pivotal movement relative to said base means about a pivot axis, and an article support member detachably mounted upon aid bracket means.

10. The invention defined in claim 9 wherein said base means comprises a base plate mounted on said carriage for movement along said second linear path, and a second plate mounted on said base plate for rotative adjustment relative to said base plate about a second axis normal to said first linear path.

11. The invention defined in claim 10 wherein said bracket means comprises a bracket mounted on said base means for pivotal movement about said pivot axis, and reversible motor means on said base means for driving said bracket in said pivotal movement.

12. The invention defined in claim 11 wherein said first guide rod support means comprises a coupling block, track means on said frame mounting said block for sliding movement along said third linear path, a coupling rod mounted in said block for pivotal movement about a coupling rod axis mutually perpendicular to said first and third linear paths, and means mounting one end of said guide rod upon said coupling rod with the longitudinal axis of said guide rod perpendicular to and intersecting said coupling rod axis.

13. The invention defined in claim 12 wherein said first positioning means comprises a screw mounted in said frame mounting said block for rotation about an axis extending parallel to said third linear path, a nut fixedly mounted in said block threadably received upon said screw, and reversible motor means on said frame for driving said screw in rotation about its axis.

* * * * *